US005522744A

United States Patent [19]

Schlogel

[11] Patent Number: 5,522,744

[45] Date of Patent: Jun. 4, 1996

[54] RETRACTABLE MARINE POWER DRIVE

[76] Inventor: Richard Schlogel, 1185 Lakeside Dr., Palatine, Ill. 60067

[21] Appl. No.: 431,973

[22] Filed: May 1, 1995

[51] Int. Cl.[6] ..... B63H 5/12

[52] U.S. Cl. ..... 440/54

[58] Field of Search ..... 440/54

[56] References Cited

U.S. PATENT DOCUMENTS 2,156,938 5/1939 Edwards ..... 440/54

3,587,512 6/1971 Patterson ..... 440/54

*Primary Examiner*—Jesus D. Sotelo

[57] ABSTRACT

An auxiliary marine propeller drive, primarily for sail boats. The propeller drive is retactable into a water tight cavity formed in the hull of the boat when not in use, thus not distracting from the symmetry of the hull design. Means are provided within the cavity in the form of vertical guides over which the propeller assembly is reciprocally removed into and out of the water tight cavity. There is also included a cam member which will effect rotation of the blades of the propeller into a set position whereby they can be moved through the smallest possible area into and out of the water tight cavity.

6 Claims, 1 Drawing Sheet

RETRACTABLE MARINE POWER DRIVE

STATEMENT OF THE PRIOR ART

Sailboats are primarily driven by auxiliary fixed blade propellers, inboard, outboard engines such as disclosed in U.S. Pat. No. 3,404,656; or folding propellers such as disclosed in U.S. Pat. No. 1,917,503.

The disadvantages inherent in these prior auxiliary marine propeller drive assemblies are readily apparent. For example the fixed plade propeller creates excessive drag when not in use and interferes with the performance of the hull design. The inboard outboard propeller drive must be stern mounted and as such its total effectiveness for a sail boat drive in high seas is relatively poor. Its position results in a poor weight distribution affecting the total performance of the sail boat. It is difficult to raise and lower and adversely affects the symmetrical design and appearance of the craft. The folding propeller has a resulting poor performance, particularly in reverse and in moderate to high winds.

STATED OBJECTS OF THE INVENTION

The purpose of this retractable propeller drive is to provide an auxiliary drive for a sail boat in a forward or reverse direction by a fixed propeller located amidship of the vessel.

When auxiliary drive is not required the blades are positioned in a pre-determined state whereby they may be retracted into a water tight cavity. Movable with the propeller is a closure plate which will plug the compartment opening, the contour of which conforms to the hull's design, resulting in minimum drag.

Other objects will appear hereinafter.

BRIEF DESCRIPTION OF DRAWINGS

The invention will be best understood by reference to the accompanying drawings which illustrate the preferred arrangement and construction of parts by which the stated objects of the invention are achieved, and in which.

GENERAL DESCRIPTION

Figure 1:
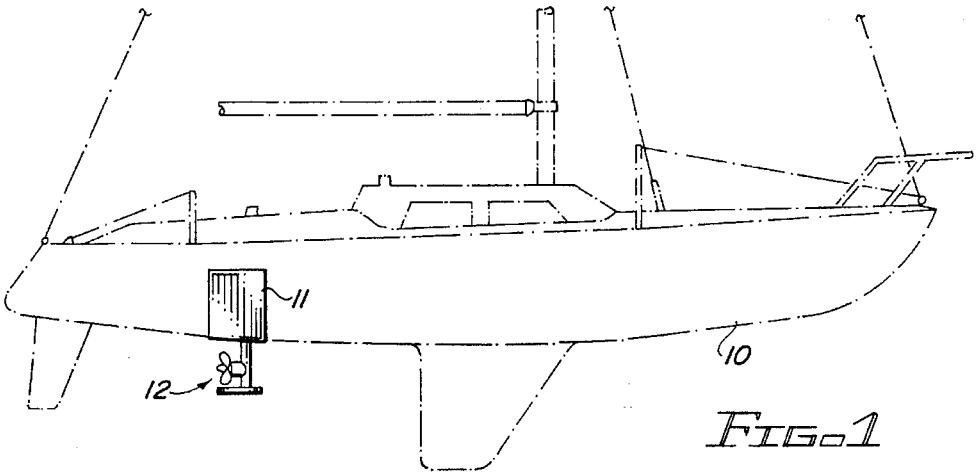
FIG. 1 is a side elevational view showing the embodiment of the invention in an extended condition with respect to a boat hull.

As illustrated in FIG. 1 there is depicted a typical boat hull 10 which is provided with an internal compartment 11 that is adapted to house a propeller unit 12.

Figure 2:
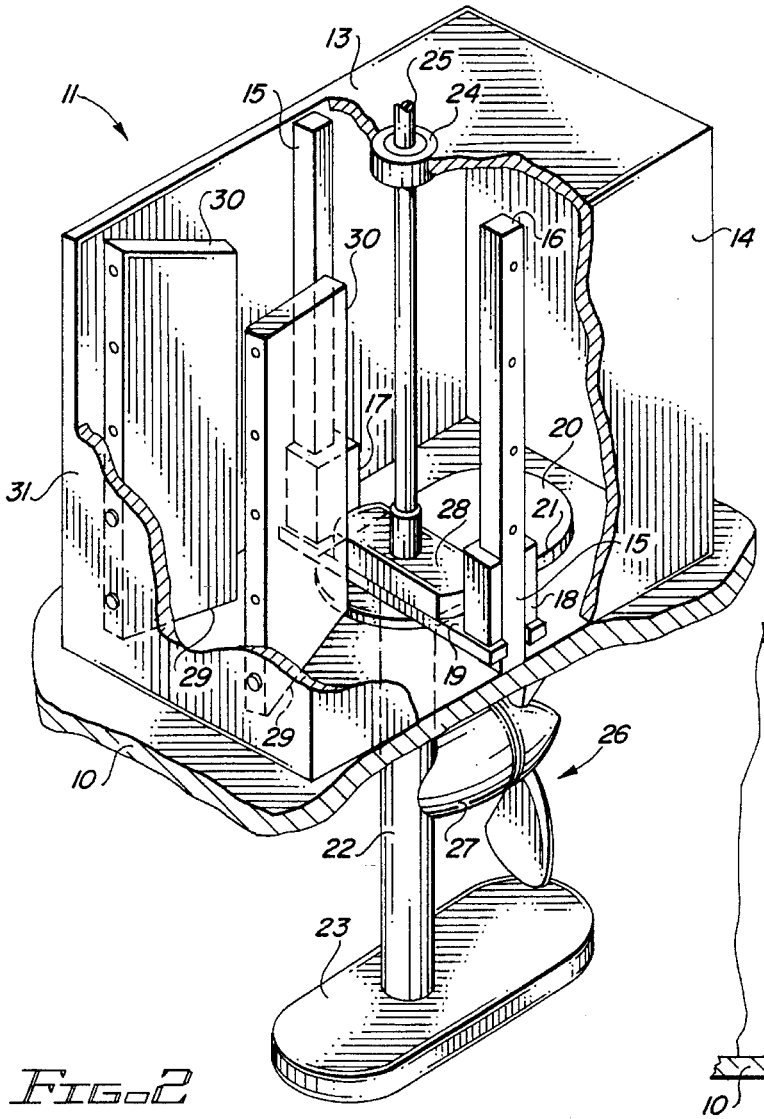
FIG. 2 is a perspective view of the invention in an extended operative position.
Figure 3:
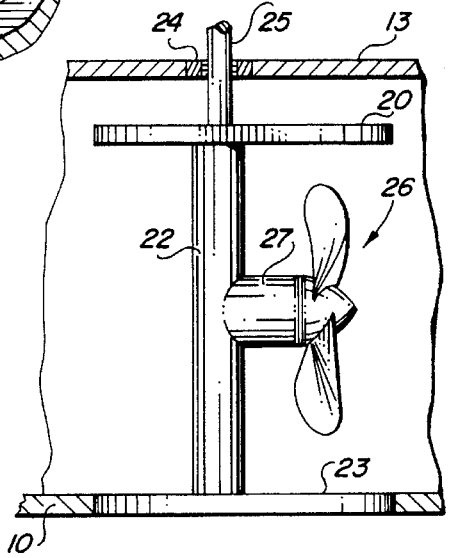
FIG. 3 is a fragmentary side elevational view of the propeller unit of the invention in an elevated or inoperative position.

The compartment 11 as depicted in FIG. 2 provides side walls 13 and 14 of which have mounted on their interior surfaces parallel vertically extending guides 15 and 16.

Adapted to be positioned upon the guides 15 and 16 are a pair generally U-shaped sliding struts 17 and 18. These struts are connected together by a base plate 19.

Beneath the base plate 19 is an elliptical shaped plug 20, which is adapted to close a corresponding elliptical shaped opening 21 formed in the hull 10 along the center line of the vessel. Extending from beneath the plug 20 is a tubular support 22 that terminates into a second elliptical shaped plug 23, which will close the bottom of compartment 11.

Adapted to extend through a sealed opening 24 formed in the top wall of the compartment 11 is a telescoping drive shaft 25 for a two bladed propeller 26. The drive shaft is freely journalled through the base plate 19 and the tubular support 22 and has operative connection through suitable gearing contained in a gear housing 27 with its propeller 26.

It is an object of this invention to require the smallest possible opening 21 in the hull 10 through which the propeller 26 can be moved into and out of operating position. To accomplish this it is desirable to rotate the blades of the propeller 26 so that they lie in a vertical plane as shown. This orientation of the propeller 26 is achieved in the following manner.

Mounted on the drive shaft 25, within the compartment 11, and extending between the struts 15 and 16, is a cam block 28, that is adapted to be rotated by the drive shaft 25, as it is rotated about its vertical axis, relative to certain edges of a pair of cam members 30. These members 30 are attached to the inner surface of the end wall 31 and extend in the direction of the shaft 25.

Upon initial upward movement of the shaft 25 the plug 20 is raised out of the opening 21 and the cam block 28 is moved upward between the struts 17 and 18. Upon rotation of the shaft 25 the cam block 28 which is of such a length that as it is rotated by shaft 25 it will engage a vertical edge of one of the cam members 30.

The cam block 28 is so orientated to the propeller 26 that when the block is rotated into contact with either one of the cam members 30, the blades of the propeller will be disposed in a vertical plane.

When the propeller 26 is retracted the bottom plug 23 will close the opening 21 in the hull 10 so as to preserve the symmetry of its design.

To raise or lower the propeller 26 the engine is stopped and declutched. When being raised the initial upward movement of the shaft 25 and its then rotation about its vertical axis will cause the cam block 28 to engage one edge of one of the cam members 30 to vertically position the propeller blades, The sliding strut 17 and 18 may be raised by any mechanical means or as a result of the vertical movement of the telescoping shaft 25. The telescoping shaft 25 may be of any conventional construction, as for example it may be constructed from sections which are telescopically and rotatable connected through cooperating pins and key ways. Its vertical movement may be, by any method, including manual operation.

It should also be noted that the cam block 28 and its associate cam members 30 may be positioned exteriorly of the compartment 11 without departing from the concept of this invention.

While I have illustrated and described the preferred form of construction for carrying my invention into effect, this is capable of variation and modification without departing from the spirit of the invention. I, therefore, do not wish to be limited to the precise details of construction as set forth, but desire to avail myself of such variations and modifications as come within the scope of the appended claims.

Having thus described my invention, what I claim as new and desire to protect by Letters Patent is:

1. A retractable auxiliary marine drive assembly for a water craft comprising:

a) a compartment formed in the hull of the craft below its water line, b) a presized opening formed in the bottom wall of said compartment and said hull, c) a propeller assembly including a propeller and a propeller drive shaft within said compartment and movable through said opening so as to be disposed outside the hull of the craft, d) means within said compartment for guiding the reciprocal movement of said propeller assembly into and out of said compartment, and e) cam for orientating the blades of said propeller in a vertical plane whereby they may move through said opening in the bottom wall of said compartment.

2. A retractable marine drive assembly as defined by claim 1 including means on said propeller assembly for closing said opening formed in the bottom wall of said compartment when said propeller assembly is positioned within said compartment as well as when it is disposed outside the hull of the craft.

3. A retractable marine drive assembly as defined by claim 2 wherein said means within said compartment for guiding the reciprocal movement of said propeller assembly into and out of said compartment comprises a pair of vertically disposed guides positioned upon opposite confronting walls of said compartment, and guide members mounted on said propeller assembly adapted for vertical reciprocal movement over said guides.

4. A retractable marine drive assembly as defined by claim 2 wherein said means for orientating the blades of said propeller into a vertical plane comprises a cam follower mounted on said propeller drive shaft for rotation therewith and cam members disposed in the path of the vertical movement of said cam follower, as said propeller assembly is moved into and out of said compartment.

5. A retractable marine drive assembly as defined by claim 1 wherein said cam within said compartment for guiding the reciprocal movement of said propeller assembly into and out of said compartment comprises a pair of vertically disposed guides positioned upon opposite confronting walls of said compartment, and guide members mounted on said propeller assembly adapted for vertical reciprocal movement over said guides.

6. A retractable marine drive assembly as defined by claim 1 wherein said cam for orientating the blades of said propeller into a vertical plane comprises a cam follower mounted on said propeller drive shaft for rotation therewith and cam members disposed in the path of the vertical movement of said cam follower, as said propeller assembly is moved into and out of said compartment.

* * * * *